US009458699B2

(12) United States Patent
Monjure et al.

(10) Patent No.: US 9,458,699 B2
(45) Date of Patent: Oct. 4, 2016

(54) SLOTTED WELLHEAD AND MULTIBOWL POLISHING TOOL WITH WOVEN POLISHING BELT

(71) Applicant: GE Oil & Gas Pressure Control LP, Houston, TX (US)

(72) Inventors: Noel Anthony Monjure, Houston, TX (US); Eugene Allen Borak, Houston, TX (US); Andrew Browne Helvenston, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 415 days.

(21) Appl. No.: 14/067,142

(22) Filed: Oct. 30, 2013

(65) Prior Publication Data

US 2015/0114654 A1 Apr. 30, 2015

(51) Int. Cl.

| | |
|---|---|
| ***E21B 37/00*** | (2006.01) |
| ***B24D 9/04*** | (2006.01) |
| ***B24B 5/40*** | (2006.01) |
| ***E21B 41/00*** | (2006.01) |

(52) U.S. Cl.

CPC ..... *E21B 37/00* (2013.01); *B24B 5/40* (2013.01); *B24D 9/04* (2013.01); *E21B 41/00* (2013.01)

(58) Field of Classification Search

CPC ..... B24B 5/40; B24B 21/004; B24D 9/04; B24D 15/023; B24D 9/085; B24D 7/16; B24D 9/06; E21B 37/00; E21B 41/00

USPC ..... 451/59, 344–359, 521

See application file for complete search history.

(56) References Cited

U.S. PATENT DOCUMENTS

| | | | | |
|---|---|---|---|---|
| 1,896,738 | A * | 2/1933 | Adornetto | B24D 9/04 451/510 |
| 3,110,137 | A * | 11/1963 | Gross | B24B 15/00 451/430 |
| 3,747,286 | A * | 7/1973 | Haigh | B24D 9/085 15/230.19 |
| 3,774,354 | A * | 11/1973 | Taylor | B24D 9/04 451/466 |
| 3,818,651 | A * | 6/1974 | Eells | B24D 9/04 101/415.1 |
| 3,877,185 | A | 4/1975 | Wells | |
| 4,536,994 | A * | 8/1985 | Krebs | B24D 9/04 451/492 |
| 4,648,447 | A | 3/1987 | Bishop | |
| 4,921,046 | A | 5/1990 | Caskey | |
| 5,839,511 | A | 11/1998 | Williams | |
| 6,152,220 | A | 11/2000 | Carmichael | |

(Continued)

OTHER PUBLICATIONS

PCT Search Report and Written Opinion issued in connection with corresponding PCT Application No. PCT/US2014/061484 on Oct. 5, 2015.

*Primary Examiner* — George Nguyen

(74) *Attorney, Agent, or Firm* — Bracewell LLP; Linda L. Morgan

(57) ABSTRACT

A tool for polishing a seal surface of a wellhead assembly includes a cylindrical tool body with an axis. The tool body includes a base member with a first end, and a second end. A tubular skirt member extends from the second end of the base member. The skirt member has a sidewall, a base end connected to the base member, and an open end opposite the base end. A plurality of axial slots extend through the sidewall of the skirt member, the axial slots being spaced circumferentially around the skirt member. A polishing belt is woven through the axial slots of the skirt member.

20 Claims, 2 Drawing Sheets

(56) References Cited

U.S. PATENT DOCUMENTS

| | | | | |
|---|---|---|---|---|
| 6,152,221 | A | 11/2000 | Carmichael | |
| 6,227,291 | B1 | 5/2001 | Carmichael | |
| 6,289,987 | B1 | 9/2001 | Lay, Jr. | |
| 6,401,813 | B1 | 6/2002 | Carmichael | |
| 6,484,802 | B1 | 11/2002 | McGarian | |
| 6,561,063 | B1 * | 5/2003 | Mulford | B24B 55/052 30/390 |
| 6,575,239 | B2 | 6/2003 | Allen | |
| 6,659,852 | B1 * | 12/2003 | Wettstein | B24B 7/18 451/344 |
| 6,758,275 | B2 | 7/2004 | Martin | |
| 6,893,335 | B2 * | 5/2005 | MacKay | B24B 23/02 451/359 |
| 7,096,950 | B2 | 8/2006 | Howlett | |
| 7,870,897 | B2 | 1/2011 | Telfer | |
| 2006/0014481 | A1 * | 1/2006 | Barous | B24D 9/04 451/350 |
| 2007/0105489 | A1 * | 5/2007 | Barous | B24B 7/188 451/350 |
| 2007/0261855 | A1 | 11/2007 | Brunet | |
| 2010/0181064 | A1 | 7/2010 | Knobloch | |
| 2013/0153245 | A1 | 6/2013 | Knobloch | |
| 2014/0352977 | A1 * | 12/2014 | Borak, Jr. | E21B 33/068 166/379 |

* cited by examiner

SLOTTED WELLHEAD AND MULTIBOWL POLISHING TOOL WITH WOVEN POLISHING BELT

BACKGROUND

1. Field of the Disclosure

The present disclosure relates in general to a tool for repairing a seal surface of a wellhead assembly and in particular, to a tool with a sanding or polishing belt to finely polish an internal or external seal surface of the wellhead assembly.

2. Description of Prior Art

Surfaces of conventional wellhead assemblies, including surfaces of a standard wellhead, multibowl wellhead, unitized wellhead, or hanger are susceptible to damage from components which form part of the drill string assembly, casing string assembly, and other oil tools which are run through such wellhead assembly. Scratches can damage or deteriorate the sealing areas intended tor elastomeric, non-elastomeric or metal to metal seals.

Although there are a number of tools available for cleaning an inner surface of a wellhead assembly, these tools utilize blades, scrapers, brushes or jets for removing debris from the inner surface of the wellhead assembly. The blades, scrapers, brushes or jets of these devices would not provide the level of restoration required to enable a pressure containing seal using elastomeric, non-elastomeric or metal to metal sealing components. Instead, the blades, scrapers, brushes or jets may themselves cause additional scratches and damage to the seal surfaces as they remove the debris.

A current method for polishing the inner bore of a wellhead assembly includes removing the blowout preventer (BOP) to enable a band polishing tool to reach the affected area. By removing the BOP, the well is no longer under complete well control. Also, it takes significant time to obtain permission to remove the BOP, to remove the BOP, and then to replace and re-test the BOP again alter the polishing operation has been completed.

SUMMARY OF THE DISCLOSURE

Embodiments of the current disclosure provide a tool which can be run through the BOP or other wellhead equipment and positioned opposite the seal areas and then rotated to clean up or polish the damaged areas. The tool can be arranged to polish seal areas on an internal surface of a wellhead or the exterior surface of tubular members such as casing, casing hangers, or unfinished pipe. The tool can perform wet or dry sanding and polishing using a sufficiently fine grained sanding belt or soft polishing belt to achieve the degree of smoothness required on the seal surfaces to enable the setting of a pressure containing seal.

In one embodiment of the present disclosure, a tool for polishing a seal surface of a wellhead assembly includes a cylindrical tool body with an axis. The tool body includes a base member with a first end, and a second end. A tubular skirt member extends from the second end of the base member. The skirt member has a sidewall, a base end connected to the base member, and an open end opposite the base end. A plurality of axial slots extend through the sidewall of the skirt member, the axial slots being spaced circumferentially around the skirt member. A polishing belt is woven through the axial slots of the skirt member.

In an alternative embodiment of the current disclosure, a tool for polishing a seal surface of a wellhead assembly includes a cylindrical tool body with an axis. The tool body has a base member with an upper end, and a lower end. The base member has external threads extending downward from the upper end. A tubular skirt member extends from the lower end of the base member. The skirt member has a skirt inner bore, a sidewall, an upper base end connected to the base member, and a lower open end opposite the base end. A plurality of axial slots extend through the sidewall of the skirt member from the open end towards the base end of the skirt member. The axial slots are spaced circumferentially around the skirt member. A circular polishing belt is woven through the axial slots of the skirt member. The polishing belt passes through one axial slot into the skirt inner bore, and through an adjacent axial slot out of the skirt inner bore. A retainer is located below the polishing belt for retaining the polishing belt in the axial slots.

In another alternative embodiment of the present disclosure, a method for polishing a seal surface of a wellhead assembly includes providing a polishing tool with a skirt member having a sidewall and a plurality of axial slots extending through the sidewall. The axial slots are spaced circumferentially around the skirt member. A polishing belt is woven through the axial slots of the skirt member such that portions of the polishing belt are located within the skirt member and portions of the polishing belt are located exterior of the skirt member. The tool is connected to an end of a drill string and lowed into the wellhead. The drill string is rotated to rotate the tool and polish a seal surface of a wellhead assembly.

BRIEF DESCRIPTION OF DRAWINGS

Some of the features and benefits of the present disclosure having been stated, others will become apparent as the description proceeds when taken in conjunction with the accompanying drawings, in which.

Figure 1:
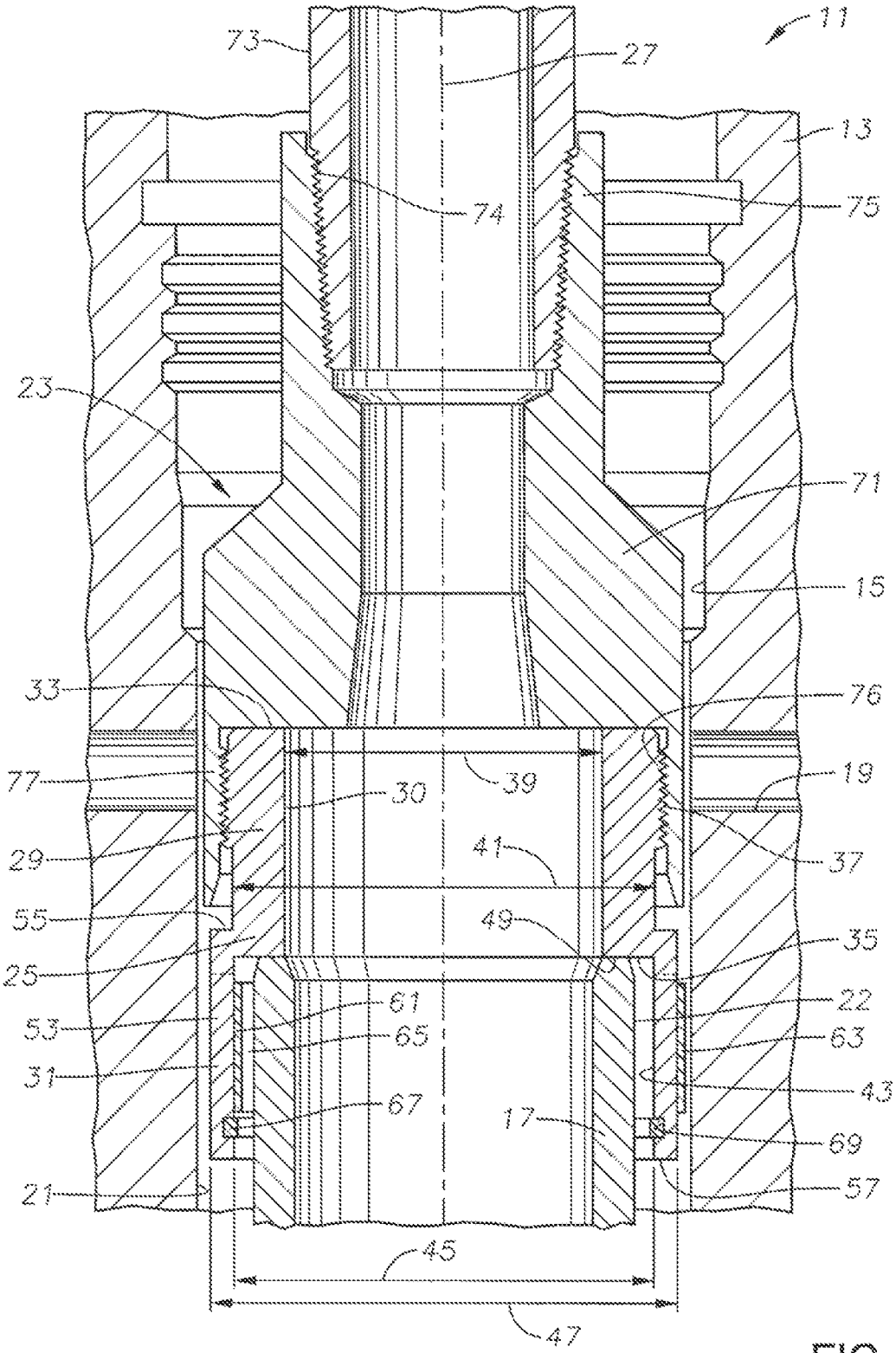
FIG. 1 is sectional diagram with a tool of an embodiment of the current disclosure located within a wellhead.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION OF DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a wellhead assembly 11 has a wellhead 13 with a central wellhead bore 15. A hanger 17 or other tubular member can be located in the wellhead bore 15. Hanger 17 can support easing or other tubing within the wellhead 13. The wellhead assembly 11 can also include a production tree (not shown) over the wellhead 13 and flow lines 19 connected to the tree or the wellhead 13. The wellhead assembly 11 can be at a surface or can be subsea. Wellhead 13 can be a standard wellhead, multibowl wellhead, unitized wellhead, or other type of wellhead that has wellhead bore 15. In other embodiments, additional or alternative members can be landed within wellhead bore 15, such as casing or unfinished pipe.

In order to prevent fields from flowing between the wellhead 13 and hanger 17, a pressure containing seal (not shown) can be set between the wellhead seal surface 21 and the hanger seal surface 22. Wellhead seal surface 21 is located on an internal surface of wellhead bore 15 and hanger seal surface 22 is located on an external surface of hanger 17. A polishing tool 23 can be used to polish seal surfaces 21, 22 before setting the pressure containing seal.

Polishing tool 23 has a cylindrical tool body 25 with a central axis 27. Tool body 25 includes a base member 29 and a skirt member 31. Base member 29 is tubular in shape with a base inner bore 30, a first or upper end 33 and a second or lower end 35 opposite upper end 31. External threads 37 extend downward from the upper end 31 on an exterior surface of base member 29. Base inner bore 30 has a base inner diameter 39 and base member 29 has a base outer diameter 41.

Skirt member 31 extends downwards torn the lower end 35 of base member 29. Skirt member 31 is tubular in shape with a skirt inner bore 43. Skirt inner bore 43 has a skirt inner diameter 45. Skirt member 31 has a skirt outer diameter 47. In the embodiment of FIG. 1, skirt inner diameter 45 is greater than base inner diameter 39 and skirt outer diameter 47 is greater than base outer diameter 41. Skirt inner diameter 45 is sized to allow a portion of hanger 17 to be located concentrically within skirt inner bore 43. A downward feeing shoulder 49 located at the lower end 35 of base member 29 can contact an upper end 51 of hanger 17, limiting the distance that hanger 17 can be located within skirt inner bore 43.

Figure 3:
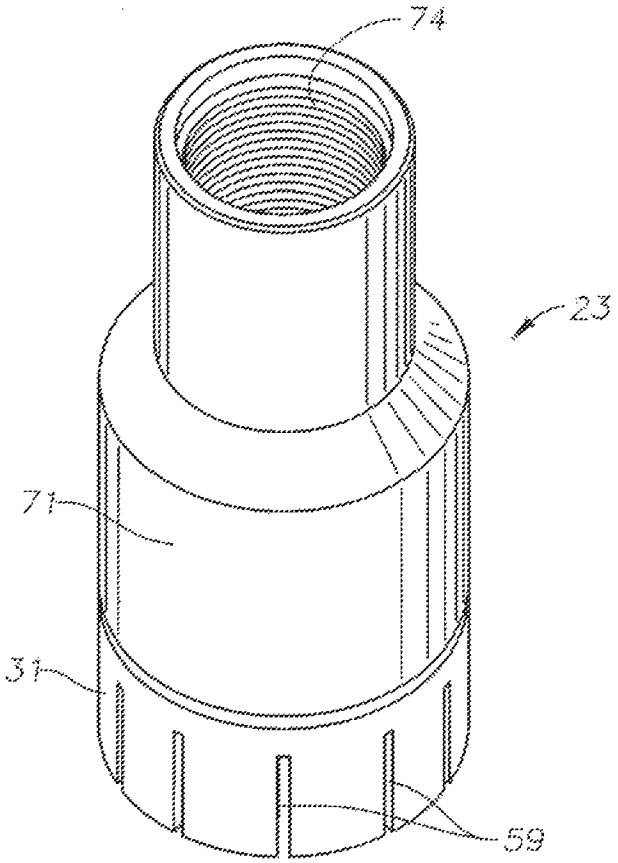
FIG. 3 is a perspective view of the tool of FIG. 1 without the polishing belt.

Skirt member 31 has a base end 55 that is connected to the base member 29, and an opposite open end 57. Skirt member 31 has a sidewall 53 that extends between the base end 55 and the open end 57. A plurality of axial slots 59 (FIG. 2-3) extend all of the way through the sidewall 53 from the open end 57 towards the base end 55 of skirt member 31. Axial slots 59 are spaced circumferentially around skirt member 31. A polishing belt 61 is woven through axial slots 59. The material, grit size, and other parameters of polishing belt 61 can be selected based on the severity and nature of damage to the seal surfaces 21, 22. Polishing belt 61 can be suitable for either wet or dry polishing. Polishing belt 61 is a circular member and can have grit, abrasive, or other polishing material 62 on its interior surface, exterior surface, or on both, depending on which seal surface 21, 22 is to be polished, as will be further discussed below.

Figure 2:
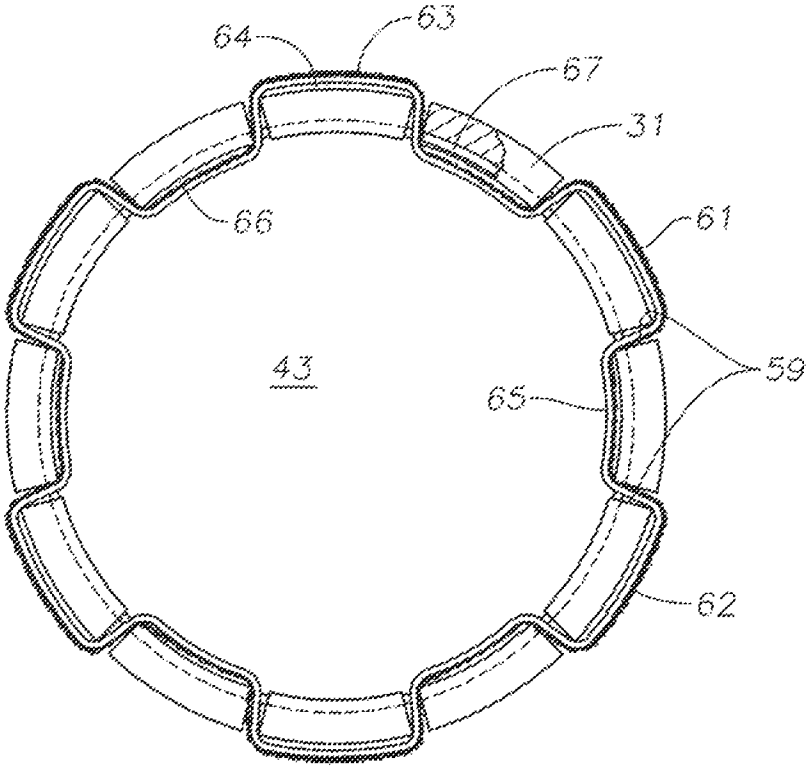
FIG. 2 is a cross sectional view of the skirt member of the tool of FIG. 1.

Turning to FIG. 2, polishing belt 61 passes through one of the axial slots 59 into the skirt inner bore 43 then passes through an adjacent axial slot 59 out of the skirt inner bore 43. This weaving pattern is repeated around the circumference of skirt member 31, resulting in exterior portions 63 of polishing belt 61 located outside of the skirt member 31 and interior portions 65 of polishing belt 61 located in the skirt inner bore 43. The circumference of polishing belt 61 is larger than the circumference of skirt member 31 so that polishing belt 61 fits loosely on skirt member 31. The exterior portions 63 are located radially outward from the outer surface of skirt member 31 defining an outer gap 64 between the outer surface of skirt member 31 and the exterior portions 63 of polishing belt 61. Similarly, the interior portions 65 are located radially inward from the inner surface of the skirt member 31, defining an inner gap 66 between the inner surface of the skirt bore 43 and the interior portions 65 of polishing belt 61. Polishing belt 61 can be a preformed continuous circular belt sized to fit skirt member 31. Alternatively, polishing belt 61 can be a length of material that is cut to fit, with the ends of the polishing belt 61 being secured together by adhesive, mechanical connectors, or other known means.

Returning to FIG. 1, a retainer 67 is located proximate to the open end 57 of the skirt member 31 for retaining the polishing belt 61 in axial slots 59. Retainer 67 does not restrict polishing belt 61 radially, but rather engages a lower side of polishing belt 61 to limit axial movement of polishing belt 61 so that polishing belt 61 does nor drop out of a bottom end of axial slots 59. In the embodiment of FIG. 1, retainer 67 is a retaining ring located within a circumferential recess 69 that is located below the lower side of polishing belt 61. Circumferential recess 69 is formed on an internal surface of the skirt inner bore 43. In alternative embodiments, retainer 67 can be located on an exterior surface of skirt member 31, or can be a lock ring or cap screws or other known means in the art. In the embodiment of FIG. 1, axial slots 59 extend completely to the bottom edge of skirt member 31. In other alternative embodiments, axial slots 59 can begin above the bottom edge of skirt member 31. In such an embodiment, the ends of polishing belt 61 are secured together after being woven through axial slots 59 and retainer 67 can comprise a portion of the skirt member 31 that is directly below each axial slot 59.

In the embodiment of FIG. 1, polishing tool 23 has an adapter 71 located adjacent to the base upper end 33 of base member 29 for connecting the tool body 25 to a drill string 73. Adapter 71 is a tubular member with internal threads 74 located at an upper or drill string region 75 and internal threads 76 located at a lower or tool region 77. Internal threads 76 in the tool region 77 mate with base external threads 37 to connect the adapter 71 to the base member 29. In an ideal embodiment, internal threads 76 and base external threads 37 are right hand threads so that the base member 29 turns to the right relative to the adapter 71 to mate internal threads 76 to base external threads 37. Internal threads 74 at the drill string region 75 mate with external threads of drill string 73. In alternative embodiments, tool body 25 can be directly connected to the drill string 73 without the use of an adapter 71. Although the connections between the tool body 25 and drill string 73 are shown as threaded connections, alternative means known in the art can also be utilized.

In operation, as an example, when the operator wishes to polish a seal surface of the wellhead assembly 11, such as a wellhead seal surface 21 or hanger seal surface 22, the operator selects an appropriate polishing belt 61 and weave polishing belt 61 through the axial slots 59 of the polishing tool 23. The retainer 67 is fastened to the polishing tool 23 to retain the polishing belt 61 in place in axial slots 59. The tool body 25 is then connected to an end of the drill string 73. This can be done by mating internal threads 76 in the tool region 77 with base external threads 37 to connect the adapter 71 to the base member 29, then mating internal threads 74 at the drill string region 75 with external threads of drill string 73. The drill string 73 is then lowered through the BOP and any other well control or otter equipment above the wellhead assembly 11, and into wellhead 13. The polishing tool 23 is sized to allow it to pass into the wellhead 13 without having to remove the BOP or other equipment located above the seal surfaces 21, 22.

If the operator desires to polish an interior surface of the wellhead assembly 13, such as wellhead seal surface 21, the drill string 73 is lowered until the polishing belt 61 is adjacent to wellhead seal surface 21. In such an embodiment, at least the exterior surface of the polishing belt 61 includes polishing material 62. The drill string 73 can then be rotated to rotate the polishing tool 23 and the exterior portions 63 of the polishing belt 61 will polish the wellhead seal surface 21. If the operator desires to polish an exterior surface of the wellhead assembly 11, such as the hanger seal surface 22, the drill string 73 is lowered until a portion of hanger 17 is located concentrically within the skirt inner bore 43 and the polishing belt 61 is adjacent to hanger seal surface 22. In such an embodiment, at least the interior surface of the polishing belt 61 includes polishing material 62. The drill string 73 can then be rotated to rotate the polishing tool 23 and the interior portions 65 of the polishing belt 61 will polish the hanger seal surface 22. If the operator desires to polish interior seal surface 21 simultaneously with exterior seal surface 22, both the exterior surface and interior surface of the polishing belt 61 will include polishing material 62.

Skirt member 31 is sized so that it will easily fit within the wellhead bore 15 and the skirt inner bore 43 is sized so that a portion of the hanger 17 can fit easily within the skirt inner bore 43. The polishing tool 23 will have mom for slight radial movement within the wellhead assembly 11, and the polishing bell 61 can oscillate or wobble as it rotates to bounce along seal surfaces 21, 22 to gently polish seal surfaces 21, 22 without applying excessive radial force to seal surfaces 21, 22. In addition, axial slots 59 allow the side wall 53 of the skirt member 31 to flex in the region of the axial slots 59. The sizing of skirt member 31, the flexibility of skirt member 31, and gaps 64, 66 between the polishing belt 61 and skirt member 31, together with the resilience of the polishing belt 61 itself, individually and when combined, reduce the likelihood that excessive radial force is applied to the wellhead seal surfaces 21, 22. This will allow polishing tool 23 to polish seal surfaces 21, 22 to the degree of smoothness required to enable the setting of a pressure containing seal while reducing the likelihood that polishing tool 23 could cause further damage to seal surfaces 21, 22.

The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

What is claimed is:

1. A tool for polishing a seal surface of a wellhead assembly, comprising:

a cylindrical tool body with an axis, the tool body comprising:

a base member with a first end, and a second end;

a tubular skirt member extending from the second end of the base member, the skirt member having a sidewall, a base end connected to the base member, and an open end opposite the base end; and a plurality of axial slots extending through the sidewall of the skirt member, the axial slots being spaced circumferentially around the skirt member;

a polishing belt woven through the axial slots of the skirt member; and a connection member located at a first end of the base member sized for connecting the base member to a tubular well string and oriented to maintain the base member with the tubular well string during rotation of the tubular well string within the wellhead assembly a subterranean well.

2. The tool of claim 1, wherein the tool further comprises a retainer in engagement with a lower side of the polishing belt for retaining the polishing belt in the axial slots.

3. The tool of claims 1, wherein the tubular skirt member has a circumferential recess formed on an internal surface below a lower side of the polishing belt, and wherein the tool further comprises a retaining ring located within the recess for retaining the polishing belt in the axial slots.

4. The tool of claim 1, further comprising an adapter connected to the first end of the base member, the adapter having internal threads at a drill string region for selectively mating with external threads of a drill string of the tubular well string.

5. The tool of claim 1, wherein the axial slots extend to the open end of the skirt member.

6. The tool of claim 1, wherein the skirt member has a skirt inner bore and the polishing belt passes through one of the plurality of axial slots into the skirt inner bore and through an adjacent axial slot out of the skirt inner bore.

7. The tool of claim 1, wherein the polishing belt has exterior portions located outside of the skirt member for selectively polishing an interior surface of the wellhead assembly.

8. The tool of claim 1, wherein the skirt member has a skirt inner bore and the polishing belt has interior portions located in the skirt inner bore for selectively polishing an exterior surface of the wellhead assembly.

9. The tool of claim 1, wherein:

the base member has a base outer diameter and a base inner bore with a base inner diameter;

the skirt member has a skirt outer diameter, skirt inner bore with a skirt inner diameter; and the skirt outer diameter is greater than the base outer diameter, and the skirt inner diameter is greater than the base inner diameter.

10. The tool of claim 1, wherein the polishing belt comprises a plurality of exterior portions and a plurality of interior portions, the plurality of exterior portions being located radially outward from an outer surface of the skirt member, defining an outer gap between the outer surface of the skirt member the exterior portions of the polishing belt; and the plurality of interior portions being located radially inward from an inner surface of the skirt member, defining an inner gap between the inner surface of the skirt member and the interior portions of the polishing belt.

11. A tool for polishing a seal surface of a wellhead assembly, comprising:

a cylindrical tool body with an axis, the tool body comprising:

a base member with an upper end and a lower end, the base member having external threads extending downward from the upper end;

a tubular skirt member extending from the lower end of the base member, the skirt member having a skirt inner bore, a sidewall, an upper base end connected to the base member, and a lower open end opposite the base end; and a plurality of axial slots extending through the sidewall of the skirt member from the open end towards the base end of the skirt member, the axial slots being spaced circumferentially around the skirt member;

a circular polishing belt woven through the axial slots of the skirt member, the polishing belt passing through one axial slot into the skirt inner bore, and passing through an adjacent axial slot out of the skirt inner bore; and a retainer located below the polishing belt for retaining the polishing belt in the axial slots.

12. The tool of claim 11, wherein the polishing belt comprises a plurality of exterior portions and a plurality of interior portion, the plurality of exterior portions being located radially outward from an outer surface of the skirt member, defining an outer gap between the outer surface of the skirt member the exterior portions of the polishing belt; and the plurality of interior portions being located radially inward from an inner surface of the skirt member, defining an inner gap between the inner surface of the skirt inner bore and the interior portions of the polishing belt.

13. The tool of claim 11, wherein the polishing belt has an interior surface and an exterior surface, and an abrasive material located on both the interior surface and the exterior surface.

14. The tool of claim 11, wherein the polishing belt has exterior portions located outside of the skirt member for selectively polishing an interior surface of the wellhead assembly.

15. The tool of claim 11, wherein the polishing belt has interior portions located in the skirt inner bore for selectively polishing an exterior surface of the wellhead assembly.

16. A method for polishing a seal surface of a wellhead assembly, comprising:

(a) providing a polishing tool with a skirt member, the skirt member having a sidewall and a plurality of axial slots extending through the sidewall, the axial slots being spaced circumferentially around the skirt member;

(b) weaving a polishing belt through the axial slots of the skirt member such that portions of the polishing belt are located within the skirt member and portions of the polishing belt are located exterior of the skirt member;

(c) connecting the tool to an end of a drill string and lowering the tool into the wellhead assembly; and (d) rotating the drill string to rotate the tool and polish a seal surface of the wellhead assembly.

17. The method of claim 16, wherein step (b) comprises weaving the polishing belt through one of the plurality of axial slots into the skirt member and through an adjacent one of the plurality of axial slots out of the skirt member.

18. The method of claim 16, wherein step (b) comprises weaving the polishing belt through the axial slots of the skirt member such that the portions of the polishing belt located within the skirt member are located radially inward from an inner surface of the skirt member, defining an inner gap between the polishing belt and the skirt member; and the portions of the polishing belt that are located exterior of the skirt member are located radially outward from an outer surface of the skirt member, defining an outer gap between the polishing belt and the skirt member.

19. The method of claim 16, wherein the step of polishing the seal surface of the wellhead assembly comprises polishing an internal surface of the wellhead assembly.

20. The method of claim 16, wherein the step of lowering the tool into a wellhead includes locating a portion of a tubular member concentrically within the skirt inner bore, and the step of polishing the seal surface of the wellhead assembly comprises polishing an external surface of the tubular member.

* * * * *